US008827116B1

(12) United States Patent
Hamilton

(10) Patent No.: US 8,827,116 B1
(45) Date of Patent: Sep. 9, 2014

(54) DISPOSABLE FLUID DISPENSER

(71) Applicant: George Wesley Hamilton, Dallas, TX (US)

(72) Inventor: George Wesley Hamilton, Dallas, TX (US)

( * ) Notice: Subject to any disclaimer, the term of this patent is extended or adjusted under 35 U.S.C. 154(b) by 0 days.

(21) Appl. No.: 14/036,802

(22) Filed: Sep. 25, 2013

(51) Int. Cl.
*A47K 5/12* (2006.01)

(52) U.S. Cl.
CPC ..... *A47K 5/1211* (2013.01)
USPC ..... 222/180; 222/321.7; 222/383.1; 222/383.3

(58) Field of Classification Search
CPC ..... B65D 83/36
USPC ..... 222/180, 181.1, 321.7–321.9, 321.1, 222/383.1, 383.3, 160, 164, 167, 162, 222/402.13; 401/181, 188 R
See application file for complete search history.

(56) References Cited

U.S. PATENT DOCUMENTS

| | | | | | |
|---|---|---|---|---|---|
| 3,083,374 | A | | 4/1963 | Watlington | |
| 3,796,185 | A | | 3/1974 | Boone | |
| 3,910,229 | A | | 10/1975 | Spencer | |
| 4,018,363 | A | | 4/1977 | Cassia | |
| 4,146,156 | A | | 3/1979 | Cassia | |
| 4,223,812 | A | * | 9/1980 | van Lit | 222/180 |
| 4,235,333 | A | | 11/1980 | Boone | |
| 4,421,254 | A | * | 12/1983 | Spector | 222/180 |
| 4,662,195 | A | | 5/1987 | von Buelow et al. | |
| 4,741,461 | A | | 5/1988 | Williamson et al. | |
| 4,765,515 | A | * | 8/1988 | Lippman | 222/162 |
| 4,771,769 | A | * | 9/1988 | Hegemann et al. | 128/200.22 |
| 4,795,063 | A | * | 1/1989 | Sekiguchi et al. | 222/105 |
| 4,798,312 | A | | 1/1989 | Scheiber | |
| 4,826,052 | A | | 5/1989 | Micallef | |
| 5,033,657 | A | | 7/1991 | Whittington | |
| 5,044,556 | A | | 9/1991 | Suzuki | |
| 5,082,149 | A | * | 1/1992 | Cross | 222/162 |
| 5,165,577 | A | | 11/1992 | Ophardt | |
| 5,197,637 | A | * | 3/1993 | Naumann | 222/207 |
| 5,359,738 | A | | 11/1994 | Kurtz | |
| 5,381,568 | A | | 1/1995 | Warkentin | |
| 5,435,465 | A | | 7/1995 | El-Amin | |
| 5,595,324 | A | | 1/1997 | Brown et al. | |
| 5,638,989 | A | | 6/1997 | Ophardt et al. | |
| 5,672,206 | A | | 9/1997 | Gorman | |
| 5,855,302 | A | | 1/1999 | Fisscher | |
| 5,887,759 | A | | 3/1999 | Ayigbe | |
| 6,216,916 | B1 | | 4/2001 | Maddox et al. | |
| 6,497,345 | B1 | | 12/2002 | Wilker et al. | |
| 6,581,804 | B1 | * | 6/2003 | Ciavarella et al. | 222/181.3 |
| 6,675,405 | B1 | | 1/2004 | Harm | |
| 6,696,025 | B2 | * | 2/2004 | Liao | 422/123 |
| 6,805,264 | B2 | * | 10/2004 | Houvras | 222/180 |
| 7,162,754 | B2 | | 1/2007 | Haile, Jr. | |
| 7,635,070 | B2 | * | 12/2009 | Cohen et al. | 222/162 |
| 8,267,610 | B2 | | 9/2012 | Goodman | |
| 8,336,740 | B1 | | 12/2012 | Daansen | |
| 2011/0174841 | A1 | * | 7/2011 | Kennedy et al. | 222/182 |

* cited by examiner

*Primary Examiner* — J. Casimer Jacyna
*Assistant Examiner* — Donnell Long
(74) *Attorney, Agent, or Firm* — Sam Sokhansanj

(57) ABSTRACT

A disposable self-contained fluid dispenser that can be easily mounted to a wall or toilet. The dispenser has a hinged integral fluid container (formed as a lever) and has a pump laterally extended from the fluid container. The fluid container is hinged to a back plate and a hood covers the top of the extended pump. The top edge of the back plate is hinged to the rear edge of the hood and the front of the hood is hinged to contact the compressible end of the pump. The three hinge points form a triangle. When the user presses the fluid container (lever) or applies downward pressure to the extended front end of the hood, the geometry of the triangle is altered thereby compressing the piston of the pump and causing fluid to be dispensed.

16 Claims, 6 Drawing Sheets

DISPOSABLE FLUID DISPENSER

FIELD OF THE INVENTION

The present document relates to the filed of fluid dispensers for sanitization and cleaning purposes.

BACKGROUND

This section is intended to introduce the reader to aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Fluid dispensers are a common method of dispensing a variety of products for general cleaning in spray and liquid form. This invention relates to dispensers that dispense fluids for body or hand use as well as dispensers for the moistening of tissue, either wall mounted or attached to a fixture such as a commode.

Many wall-mounted dispensers utilize replaceable containers of fluid in permanent housings such as U.S. Pat. No. 8,336,740 to Dassen. This type of dispenser is primarily for commercial installation as the expense and complexity of maintenance make this type of dispenser unsuitable for general home use in the bath or shower.

Dispensers that are attachable to a commode or fixture and provide a means of moistening tissue are described in U.S. Pat. No. 4,798,312 by Scheiber and also in U.S. Pat. No. 5,887,759 by Ayigbe. These types of dispensers are difficult to attach to many bathroom fixtures and when they are used on an applicable fixture, the proximity of the dispenser to the tissue makes their use difficult.

Dispensers directly attachable to a commode for body cleaning or for the moistening of tissue such as U.S. Pat. No. 7,162,754 by Haile, Jr. or U.S. Pat. No. 6,675,405 by Harm, utilize water from the house as a cleansing fluid. Installation and maintenance, unsightly appearance and sanitation are concerns as well as being difficult to use.

The need exists for a self-contained fluid dispenser, one that is disposable and adaptable to a variety of uses as well as having good ergonomic design and function. The dispenser should be easy to operate by using only a single hand, be attractive in appearance and aesthetics, and can be simply attached and removed from a wall, toilet, or commode.

BRIEF SUMMARY OF THE INVENTION

The advantages and object of this invention is to provide a fluid dispenser that is inexpensive, disposable, self-contained, sanitary and suitable for mounting to a wall, toilet, fixture, or commode. The dispenser of the present invention provides a means of controlling the amount or fluid dispersed as well as being operated with a single hand by either pressing on the fluid container (which is formed as a lever) or pressing downward on the hood of the dispenser.

Further, the disposable dispenser of the present invention is self-contained and the entire dispenser can simply be replaced. In addition, the disposable dispenser of the present invention is easily attached or removed from a wall, commode, or toilet. Further, the dispenser provides a choice of the type of fluid in the dispenser, the color or fragrance as well as providing good sanitary conditions.

In one aspect of the present invention, a fluid dispenser is provided having a back plate, a first body for storing a fluid, wherein the first body is coupled to a fluid dispensing pump, a second body for at least partially enclosing the first body and the fluid dispensing pump, and wherein the first and second body pivot with respect to the back plate, thereby dispensing the fluid. In addition, the fluid dispensing pump further comprises a pump head and wherein the second body at least partially engages the pump head. Also, the first body pivots via a first hinge and the second body pivots via a second hinge.

The pump of the fluid dispenser can be actuated by a user applying vertical downward pressure on the second body. The pump can also be actuated by a user applying lateral inward pressure on the first body. In addition, a protrusion on the second body engages a recess on the pump head. Further, the fluid dispenser can be disposable and can be attached to one or more of: a wall, fixture, toilet, bidet, or commode.

The back plate of the fluid dispenser can be attached to a surface via an adhesive. Also, the back plate can be coupled to either a wall or toilet via an adhesive. The second body can be substantially perpendicular relative to the back plate before the pump is actuated and is at an acute angle relative to the back plate after the pump is actuated. The back plate further includes an opening for receiving a bracket, wherein the bracket can be fixed to a surface. The bracket includes a first part for coupling to the back plate of the fluid dispenser and a second part for coupling to a surface. Here, the second part of the bracket includes first and second channels configured to allow the first part to slide relative to the second part. In addition, the fluid dispenser is configured to wet or moisten one or more of: tissue, toilet paper, wipe, and a user's hand.

In another aspect of the present invention, a fluid dispenser is provided having a back plate configured to affix to a surface, a container for storing a fluid, wherein the container is configured to operate as a lever for dispensing the fluid, a cover coupled to the container, wherein the cover is configured to operate as a lever for dispensing the fluid, a pump coupled to the container, wherein the pump further comprises a pump head, and wherein the cover engages the pump head thereby dispensing the fluid in a downward direction.

In another aspect of the present invention, a fluid dispenser is provided having a back plate configured to affix to a surface, a container for storing a fluid, wherein the container is configured to operate as a lever for dispensing the fluid, a cover coupled to the container, wherein the cover is configured to operate as a lever for dispensing the fluid. Further, a pump is coupled to the container, wherein the pump further comprises a pump head, and wherein the cover engages the pump head thereby dispensing the fluid.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
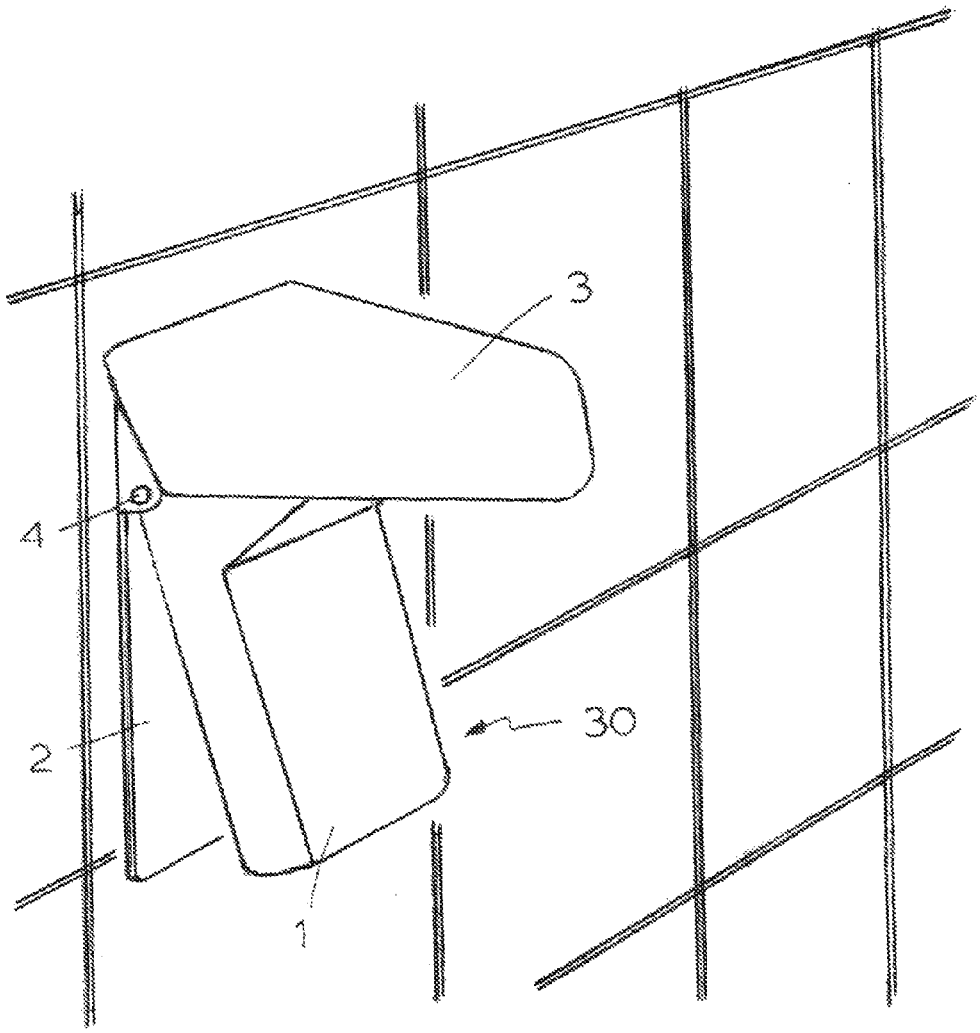
FIG. 1 illustrates the dispenser in one embodiment as mounted to a wall, such as on a bathroom or shower wall.

In the Summary of the Invention above and in the Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

The embodiments set forth below represent the necessary information to enable those skilled in the art to practice the invention and illustrate the best mode of practicing the invention. In addition, the invention does not require that all the advantageous features and all the advantages need to be incorporated into every embodiment of the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Terms and phrases similar to "commode" or "toilet" can be any type of American or European style toilet, flush toilet, dry toilet, UD toilet, chemical toilet, public toilet, floating toilet, chamber pot, urinal, squat toilet, or bidet.

Figure 9:
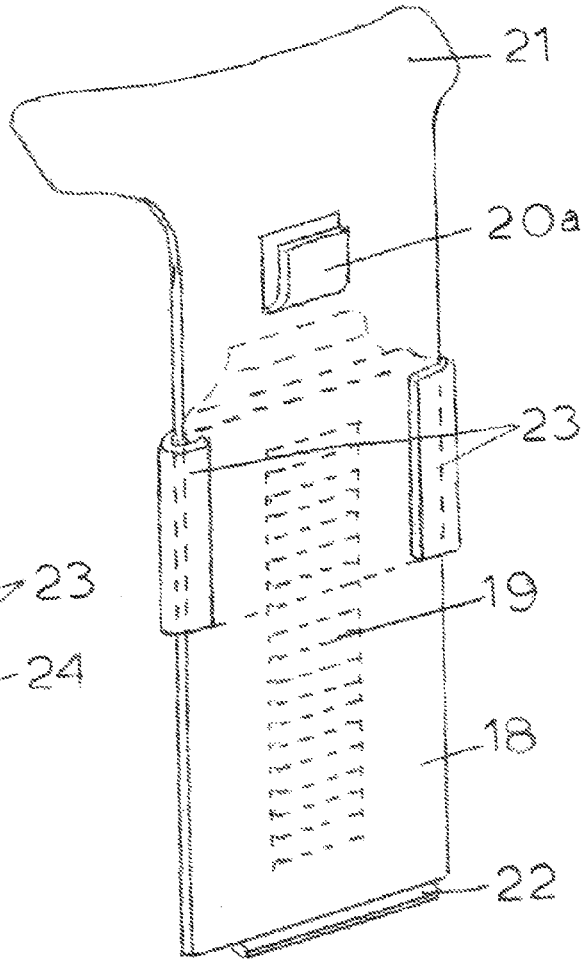
FIG. 9 illustrates one embodiment of a bracket for mounting the dispenser to a commode or toilet.
Figure 11:
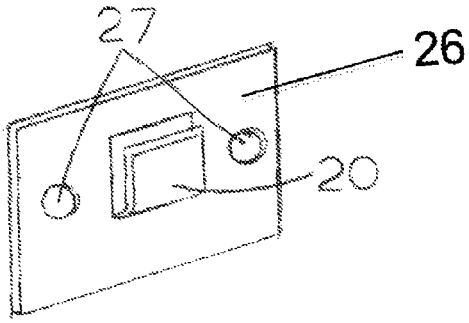
FIG. 11 illustrates another embodiment of a bracket for mounting the dispenser to a wall.

FIG. 1 illustrates the dispenser 30 shown mounted on a tile wall in one embodiment, wherein dispenser 30 has a back plate 2 that is held in place with adhesive or tape. On walls not suitable for adhesive or tape, the dispenser 30 is mounted using a bracket 26 (FIG. 11) having mounting holes for fasteners or screws 27 or alternatively the dispenser is mounted on a toilet or wall using bracket 18 (FIG. 9). Referring to FIG. 11, a "U" hook 20 is formed on the wall bracket 26 in order to attach the bracket to the back plate 2 of the dispenser 30. Similarly, FIG. 9 illustrates another embodiment of a toilet or commode bracket 18 having a "U" hook 20*a* for attaching the dispenser to a toilet by attaching bracket 18 to the back plate 2 of the dispenser 30. The fluid container 1 is formed as a lever and pivots via hinge 4 with respect to the back plate 2, and wherein dispenser 30 further includes a covering hood 3. Operation of the dispenser 30 is achieved by a user pressing latterly against the fluid container lever 1 or applying downward pressure on the front or top portion of the covering hood 3, as illustrated in FIG. 2, in order to wet or moisten a wipe, toilet paper, or tissue 28.

Figure 2:
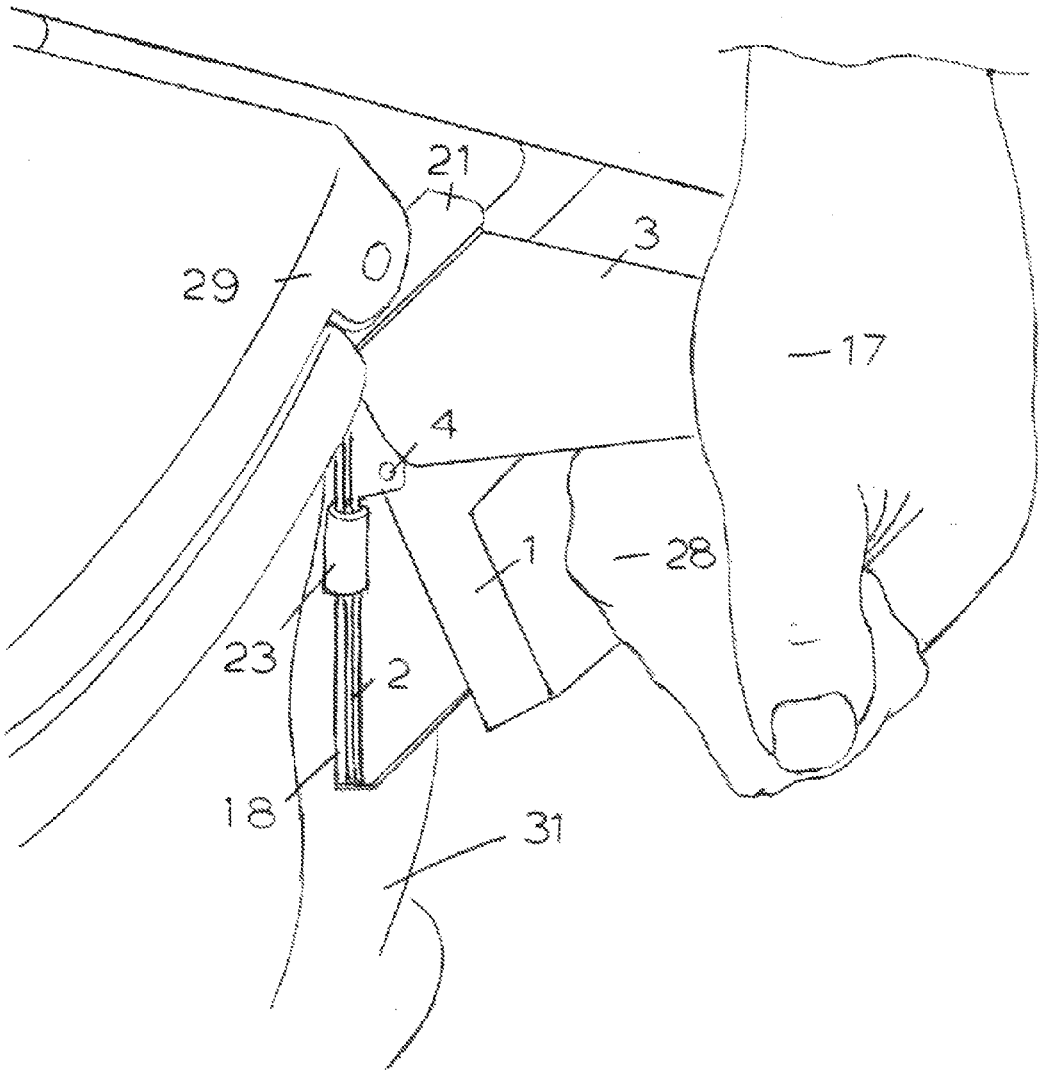
FIG. 2 illustrates the dispenser in another embodiment as mounted to a commode or toilet, and further illustrating the method of use by a user for the moistening of tissue.
Figure 10:
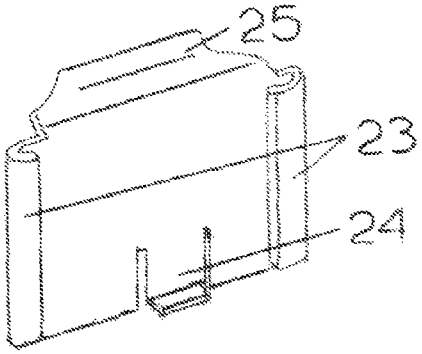
FIG. 10 illustrates a clamp for the bracket of FIG. 9.

FIG. 2 illustrates the dispenser 30 in another embodiment as attached to a commode or toilet 31 using the mounting bracket 18 having a "U" hook 20 and a protruding ledge or extending lip 22 at the bottom of bracket 18 for aligning or sitting the back plate 2 of dispenser 30 thereon. In the embodiment shown in FIG. 2, tissue 28 is wetted or moistened by the liquid contents of dispenser 30 by applying downward pressure with the hand 17 to the outer end area of the hood 3. The preferred location to mount the bracket 18 is adjacent to the toilet seat hinge assembly 29. Mounting may be made on either side of the toilet 31. Referring to FIG. 9 and FIG. 10, the toilet bracket 18 has an upper clamp 21 and a lower sliding clamp 23. The portions of the clamps 21 and 25 contact the toilet 31 and have an adhesive or tape suitable for the attachment to toilet 31. The lower clamp 25 has a spring or biased lever 24 that engages a series of slits or notches 19 on the mounting bracket 18. The contact of the upper clamp 21 and the toilet contact lower clamp 25 to the toilet 31 form a solid mount for the bracket 18 to toilet 31.

Figure 3:
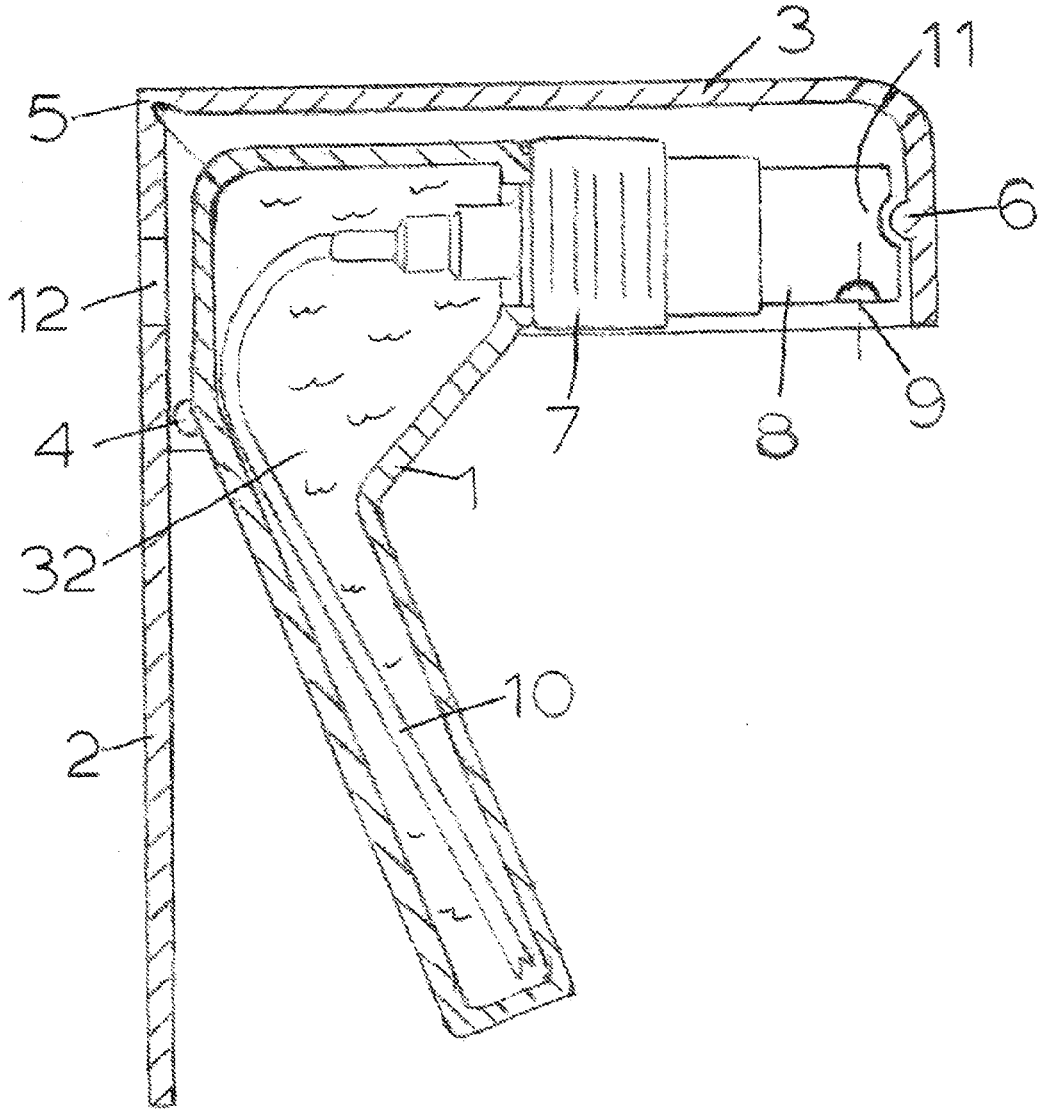
FIG. 3 illustrates a cross-sectional side view of the dispenser.
Figure 4:
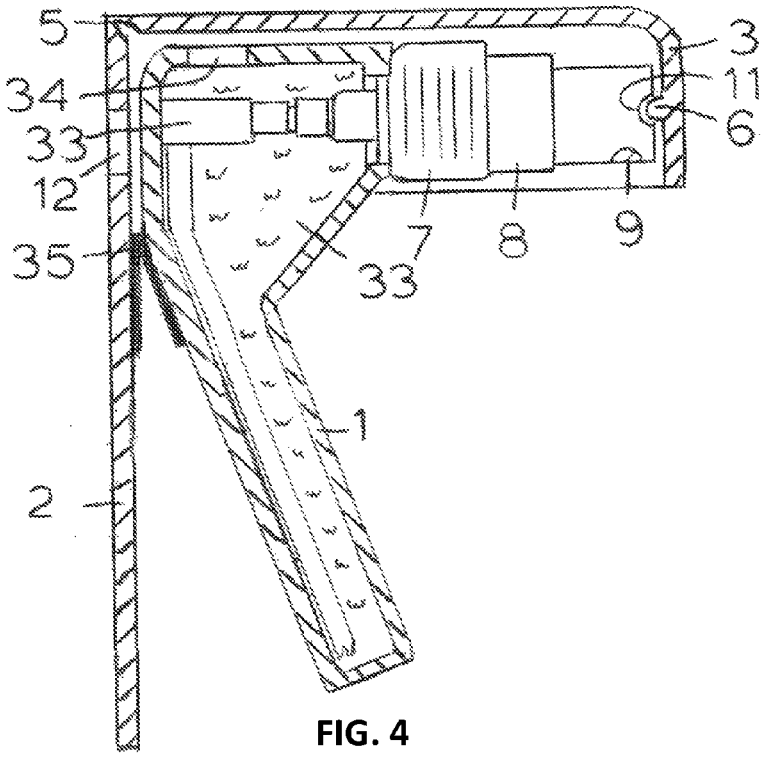
FIG. 4 illustrates a more detailed cross-sectional side view of the handle component of the fluid container and pump as used for high viscosity fluids and with a hole in the top of the fluid container, further incorporating one embodiment for using a laminate bond hinge.

FIG. 3 illustrates a cross-sectional side view of the dispenser 30, illustrating the functional parts of the dispenser. A commercially available type compression pump 7, common to the cosmetic and hygiene industries, is assembled and attached to the fluid container 1. For example, pump 7 can be any type of liquid or foam dispensing pump, such as a spray pump or mist pump having any type of spray pattern or nozzle and with or without a dipstick. Acceptable means of pump 7 attachment to the fluid container 1 are by crimping, bonding and by screw thread, with the crimping being preferable. A pump head 8 of the pump 7 contains the dispensing orifice or nozzle 9 for dispensing fluid 32. The top surface of the pump head 8 of the pump 7 has a formed semi-circular 1 dimple or recess 11, perpendicular to the orifice or nozzle 9, wherein recess 11 is in communication and engages with a semicircular protrusion 6 of the hood 3, thus forming a hinge or pivoting support. The elongated dip tube 10 of the pump 7 is bendable and can be of any length. Further, special consideration may be taken for proper filling of fluid 32 and dip tube 10 may be appropriate for low viscosity cleaning fluids. However, in another embodiment as shown in FIG. 4, when using high viscosity fluid 33, a more heavy duty or large dip tube assembly 13 may be used. As shown in FIG. 4, a hole or opening 34 in the top of the fluid container provides an alternate means of filling the fluid dispenser or inserting the dip tube 13. Further, opening 34 may have a removable cap or be permanently sealed. In the current embodiment, the hinge 4 for the back plate 2 and the fluid container 1 (lever) use a hole and pin hinge assembly common to the industry. However, a hinge formed utilizing bonded non-stretchable, flexible material 35 may be used as well. The back plate 2 has a nest opening 12 to receive and securely engage the "U" hook 20*a* from wall bracket 26 and to the wall or toilet bracket 18.

Figure 5:
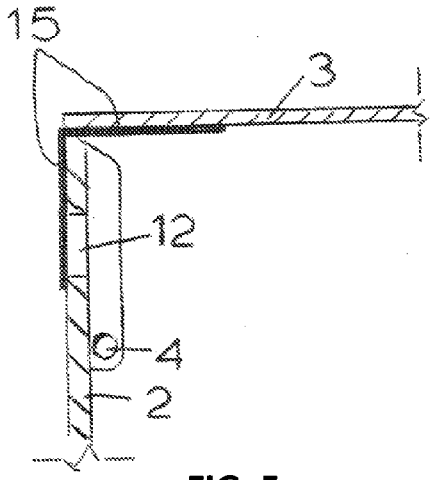
FIG. 5 illustrates one embodiment of the laminate bond hinge of the dispenser back plate and hood assembly.
Figure 6:
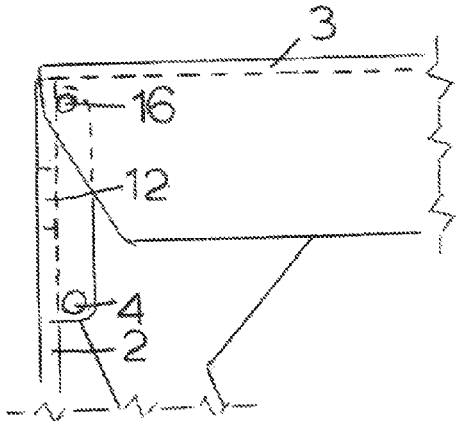
FIG. 6 illustrates another embodiment of a hinge for the dispenser back plate and hood assembly.

Referring to FIG. 3, the back plate 2 and the hood 3 of dispenser 30 may be formed or molded as a single unitary component. However, it is contemplated within the scope of the invention that may be two separate components assembled or coupled together. Further, a hood bias or hinge 5 can be created by modifying the material being used, such as thinning the material. However, it is contemplated within the scope of the invention that any type of hinge or spring bias mechanism may be incorporated. For example, materials including but not limited to plastics, thermoplastics, polycarbonate, polypropylene, polyethylene and other and similar materials may be used for the hood 3 or hinge 5 assembly. In another embodiment, as shown in FIG. 5, the back plate 2 and hood 3 may be formed as separate parts and joined to form a free moving hood hinge or biasing mechanism for the hood 3 with respect to plate 2 by utilizing a bonded non-stretchable flexible material 15. In another embodiment, as shown in FIG. 6, a standard hole and pin assembly hinge 16 may be used to attach the back plate 2 to the hood 3, thereby forming a hinge for the hood 3 with respect to back plate 2. The fluid container 1 may be formed in two parts by injection molding, compression molding or by as a single piece by blow molding.

Figure 7:
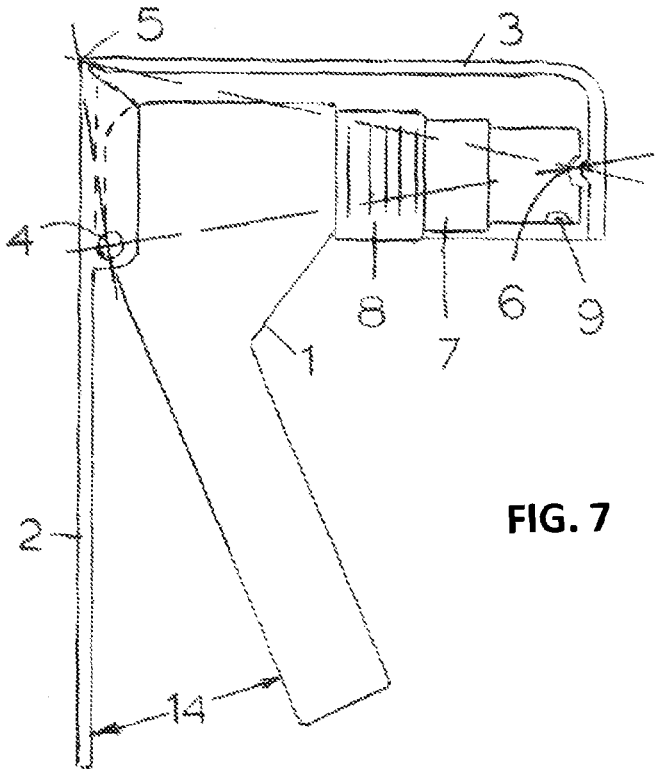
FIG. 7 and FIG. 8 illustrate the method of operation of the dispenser pump as a function of a triangular hinged design.
Figure 8:
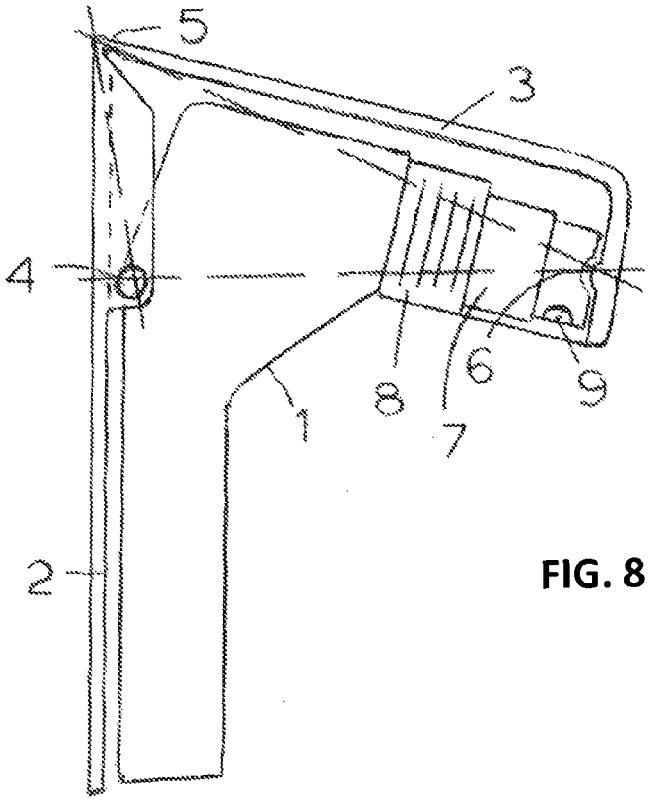

FIG. 7 and FIG. 8 illustrate the functional operation of the dispenser 30. Here, dispenser 30 is shown utilizing three hinge points in a triangular design and further illustrate the dispenser 30 in an open (FIG. 7) and closed position (FIG. 8). In the open position, as shown in FIG. 7, the fluid container lever 1 is approximately at a 22½ degree angle 14 relative to the back plate 2. However, it is contemplated within the scope of the invention that the lever 1 may be at any angle with respect to the back plate 2. The angles in the triangular design show the effect of either downward pressure on the front end of the hood 3 exerted by a user or sideways or lateral pressure to the fluid container lever 1 exerted by a user in compressing the pump head 8 and dispensing the fluid within the fluid container 1 through orifice 9.

It is contemplated within the scope of the invention that the fluid contained within the fluid container of the dispenser can be water or any type of liquid, cream, or gel substance having one or more cleaning agents or sanitizing ingredients.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention. Although the present invention has been described in considerable detail with reference to certain preferred versions or embodiments thereof, other versions and embodiments are possible. Therefore, the spirit and scope of the appended claims should not be limited to the description of the preferred versions contained herein.

What is claimed is:

1. A fluid dispenser comprising:

a back plate;

a first body for storing a fluid, wherein the first body is coupled to a fluid dispensing pump;

a second body for at least partially enclosing the first body and the fluid dispensing pump; and wherein the first and second body pivot with respect to the back plate, thereby dispensing the fluid, wherein the first body pivots via a first hinge and the second body pivots via a second hinge, and wherein the first hinge is located below the second hinge.

2. The fluid dispenser of claim 1, wherein the fluid dispensing pump further comprises a pump head and wherein the second body at least partially engages the pump head.

3. The fluid dispenser of claim 1, wherein the pump is actuated by a user applying vertical downward pressure on the second body.

4. The fluid dispenser of claim 1, wherein the pump is actuated by a user applying lateral inward pressure on the first body.

5. The fluid dispenser of claim 1, wherein a protrusion on the second body engages a recess on the pump head.

6. The fluid dispenser of claim 1, wherein the fluid dispenser is disposable.

7. The fluid dispenser of claim 1, wherein the fluid dispenser may be attached to one or more of: a wall, fixture, toilet, bidet, or commode.

8. The fluid dispenser of claim 1, wherein the back plate is coupled to either a wall or toilet via an adhesive.

9. The fluid dispenser of claim 1, wherein the second body is substantially perpendicular relative to the back plate before the pump is actuated and is at an acute angle relative to the back plate after the pump is actuated.

10. The fluid dispenser of claim 1, wherein the back plate is attachable to a surface via an adhesive.

11. The fluid dispenser of claim 1, wherein the back plate further includes an opening for receiving a bracket, wherein the bracket can be fixed to a surface.

12. The fluid dispenser of claim 1, wherein the bracket includes a first part for coupling to the back plate of the fluid dispenser and a second part for coupling to a surface.

13. The fluid dispenser of claim 1 wherein the second part of the bracket includes first and second channels configured to allow the first part to slide relative to the second part.

14. The fluid dispenser of claim 1, wherein the fluid dispenser is configured to wet or moisten one or more of: tissue, toilet paper, wipe, and a user's hand.

15. A fluid dispenser comprising:

a back plate configured to affix to a surface;

a container for storing a fluid, wherein the container is configured to operate as a lever for dispensing the fluid;

a cover coupled to the container, wherein the cover is configured to operate as a lever for dispensing the fluid;

a pump coupled to the container, wherein the pump further comprises a pump head;

wherein the cover engages the pump head thereby dispensing the fluid in a downward direction, wherein the container and cover pivot with respect to the back plate, thereby dispensing the fluid, wherein the container pivots via a first hinge and the cover pivots via a second hinge, and wherein the first hinge is located below the second hinge.

16. A fluid dispenser comprising:

a back plate configured to affix to a surface;

a container for storing a fluid, wherein the container is configured to operate as a lever for dispensing the fluid;

a cover coupled to the container, wherein the cover is configured to operate as a lever for dispensing the fluid;

a pump coupled to the container, wherein the pump further comprises a pump head; and wherein the cover engages the pump head thereby dispensing the fluid, wherein the container and cover pivot with respect to the back plate, thereby dispensing the fluid, wherein the container pivots via a first hinge and the cover pivots via a second hinge, and wherein the first hinge is located below the second hinge.

* * * * *